US012422193B2

(12) United States Patent
Kim et al.

(10) Patent No.: US 12,422,193 B2
(45) Date of Patent: Sep. 23, 2025

(54) HEAT PIPE UNIT AND WASTE HEAT RECOVERY BOILER INCLUDING SAME

(71) Applicant: DOOSAN ENERBILITY CO., LTD., Changwon (KR)

(72) Inventors: Kyu Man Kim, Busan (KR); Chilyeong Seon, Yongin (KR); Jong Ho Hong, Changwon (KR); Jin Il Kim, Changwon (KR)

(73) Assignee: DOOSAN ENERBILITY CO., LTD, Changwon (KR)

( * ) Notice: Subject to any disclaimer, the term of this patent is extended or adjusted under 35 U.S.C. 154(b) by 202 days.

(21) Appl. No.: 18/364,615

(22) Filed: Aug. 3, 2023

(65) Prior Publication Data

US 2024/0175639 A1 May 30, 2024

(30) Foreign Application Priority Data

Nov. 29, 2022 (KR) ..... 10-2022-0162830

(51) Int. Cl.
*F28F 9/013* (2006.01)
*F22B 1/02* (2006.01)
(Continued)

(52) U.S. Cl.
CPC ..... *F28D 15/0275* (2013.01); *F22B 1/021* (2013.01); *F28F 9/0131* (2013.01);
(Continued)

(58) Field of Classification Search
CPC .... F22B 7/06; F22B 7/08; F22B 1/021; F22B 13/026; F15D 1/04; F28F 2210/10
See application file for complete search history.

(56) References Cited

U.S. PATENT DOCUMENTS 3,267,914 A 8/1966 Foster
4,050,881 A * 9/1977 Watson, Jr. ..... B23K 1/0012 228/183
(Continued)

FOREIGN PATENT DOCUMENTS

CN 105202509 A 12/2015
KR 10-1465047 B1 12/2014
(Continued)

OTHER PUBLICATIONS

Translation of SU1755011A1 named Translation—SU1755011A1 (Year: 1992).*

*Primary Examiner* — Paul Alvare
(74) *Attorney, Agent, or Firm* — Harvest IP Law, LLP

(57) ABSTRACT

Proposed is a heat pipe unit and a waste heat recovery boiler including the same, wherein a heat pipe unit includes a plurality of heat pipes provided inside a casing part of a waste heat recovery boiler and a plurality of connection pipes connecting the plurality of heat pipes to each other. The heat pipes are disposed in a plurality of rows along a direction in which the exhaust gas flows. The connection pipes include a plurality of first connection pipes disposed in oblique directions and connecting the plurality of heat pipes disposed in corresponding front and rear side rows, and a plurality of second connection pipes connecting the plurality of heat pipes disposed in corresponding front and rear side rows and disposed not to be parallel with the plurality of first connection pipes.

2 Claims, 4 Drawing Sheets

(51) Int. Cl.

| | |
|---|---|
| ***F22B 7/06*** | (2006.01) |
| ***F22B 7/08*** | (2006.01) |
| ***F28D 1/04*** | (2006.01) |
| ***F28D 15/02*** | (2006.01) |
| ***F28F 9/02*** | (2006.01) |

(52) U.S. Cl.
CPC ..... *F28F 9/02* (2013.01); *F22B 7/06* (2013.01); *F22B 7/08* (2013.01); *F28D 1/04* (2013.01); *F28F 2210/10* (2013.01)

(56) References Cited

U.S. PATENT DOCUMENTS

| | | | | |
|---|---|---|---|---|
| 4,522,157 | A * | 6/1985 | O'Sullivan | F22B 37/36 122/367.1 |
| 4,549,605 | A * | 10/1985 | Sacca | F28F 9/0217 165/150 |
| 4,576,121 | A * | 3/1986 | Thorogood | C10G 1/00 165/110 |
| 4,627,386 | A | 12/1986 | Duffy et al. | |
| 5,944,089 | A * | 8/1999 | Roland | F28D 1/0475 165/145 |
| 10,895,420 | B2 * | 1/2021 | Stratman | F28D 1/0475 |
| 2006/0008394 | A1 * | 1/2006 | Muramoto | F28D 7/08 422/171 |
| 2012/0186787 | A1 | 7/2012 | Dinh | |
| 2013/0213626 | A1 | 8/2013 | Anderson | |
| 2013/0227946 | A1 * | 9/2013 | Berger | F22B 21/24 165/175 |

FOREIGN PATENT DOCUMENTS

| | | | | |
|---|---|---|---|---|
| SU | 1755011 | A1 * | 8/1992 | |
| WO | WO-8300371 | A * | 2/1983 | C03B 37/16 |

* cited by examiner

HEAT PIPE UNIT AND WASTE HEAT RECOVERY BOILER INCLUDING SAME

CROSS REFERENCE TO RELATED APPLICATION

The present application claims priority to Korean Patent Application No. 10-2022-0162830, filed on Nov. 29, 2022, the entire contents of which are incorporated herein for all purposes by this reference.

BACKGROUND OF THE INVENTION

1. Field of the Invention

The present disclosure relates to a heat pipe unit and a waste heat recovery boiler including the same. More specifically, the present disclosure relates to a heat pipe unit and a waste heat recovery boiler including the same, which allow a fluid to have heat absorption from exhaust gas uniformly.

2. Description of the Background Art

In general, a heat recovery steam generator (HRSG) is a type of heat exchanger. It functions by vaporizing water into steam by circulating water along a heat pipe in an evaporator. This process is accomplished by utilizing the combustion gas that is discharged from a gas turbine, or a similar heat source.

In addition, the heat recovery steam generator is provided with a plurality of heat pipes. These heat pipes are designed to allow water to flow inside them and absorb the heat of the combustion gas. They are positioned perpendicular to the direction in which =the combustion gas is moving. This arrangement ensures efficient heat transfer and facilitates the vaporization of water within the generator.

The combustion gas discharged from the gas turbine proceeds along the evaporator of a once-through steam generator. In the moving direction of the combustion gas, the temperature of the upstream side of the combustion gas is relatively higher than that of the downstream side.

Therefore, the amount of steam generated from the heat pipe located upstream is relatively large, and the amount of steam generated from the heat pipe located downstream is relatively small. Accordingly, a relatively large amount of water evaporates on the upstream side.

However, in the moving direction of the combustion gas, steam generation conditions are different between the upstream side and the downstream side, so the generated steam or the condition of the generated steam in each of the heat pipes is different from one another. Due to the varying conditions of the steam generated in the steam generator, the performance of the steam generator can be negatively affected, leading to difficulties in control.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of an embodiment of the present disclosure is to provide a heat pipe unit and a waste heat recovery boiler including the same, that address the issue of non-uniform heat absorption by the fluid within the heat pipes due to temperature differences caused by its flow rate and the direction of the exhaust gas. This objective is achieved by connecting the plurality of heat pipes, wherein the plurality of heat pipes is disposed in a plurality of rows along a direction in which the exhaust gas flows in a waste heat recovery boiler and is continuously connected using a plurality of connection pipes.

In order to achieve the above objective, according to the present disclosure, there may be provided a heat pipe unit including a plurality of heat pipes provided inside a casing part of a waste heat recovery boiler and a plurality of connection pipes connecting the plurality of heat pipes to each other, wherein the plurality of heat pipes has a fluid which moves thereinside and exchanges heat with exhaust gas flowing out to an outside the casing part, the plurality of heat pipes being disposed in a plurality of rows along a direction in which the exhaust gas flows, wherein the plurality of connection pipes may include: a plurality of first connection pipes disposed in oblique directions and connecting the plurality of heat pipes disposed in a first front side row with the plurality of heat pipes disposed in a first rear side row; and a plurality of second connection pipes connecting the plurality of heat pipes disposed in a second front side row with the plurality of heat pipes disposed in a second rear side row, and disposed not to be parallel with the plurality of first connection pipes, wherein the first front and rear side rows and the second front and rear side rows are referred to on the basis of the direction in which the exhaust gas flows.

In the heat pipe unit according to the present disclosure, the plurality of first connection pipes and the plurality of second connection pipes may be disposed to intersect with each other.

The plurality of first connection pipes may include: a plurality of 1-1 connection pipes connecting a first portion of the plurality of heat pipes disposed in the first front side row and a first portion of the plurality of heat pipes disposed in the first rear side row, the first front side row and the first rear side row being space apart; and a plurality of 1-2 connection pipes connecting a second portion of heat pipes in the first front side row and a second portion of the plurality of heat pipes in the first rear side row, wherein the second portion of the plurality of heat pipes in the first front side row is disposed adjacent to the first portion of the plurality of heat pipes in the first front side row, and the second portion of the plurality of heat pipes in the first rear side row is disposed adjacent to the first portion of the plurality of heat pipes in the first rear side row, wherein the plurality of 1-1 connection pipes and the plurality of 1-2 connection pipes are disposed to intersect each other.

The plurality of second connection pipes may include: a plurality of 2-1 connection pipes connecting a first portion of the plurality of heat pipes disposed in the second front side row and a first portion of the plurality of heat pipes disposed in the second rear side row, the plurality of 2-1 connecting pipes intersecting with the plurality of 1-1 connection pipes; and a plurality of 2-2 connection pipes connecting a second portion of the plurality of heat pipes in the second front side row and a second portion of the plurality of heat pipes in the second rear side row, wherein the second portion of the plurality of heat pipes in the second front side row is disposed adjacent to the first portion of the plurality of heat pipes in the second front side row, and the second portion of the plurality of heat pipes in the second rear side row is disposed adjacent to the first portion of the plurality of heat pipes in the second rear side row, wherein the plurality of 2-1 connection pipes and the plurality of 2-2 connection pipes are disposed to intersect each other.

The plurality of 1-1 connection pipes and the plurality of 2-1 connection pipes are disposed to intersect each other, and the plurality of 1-2 connection pipes and the plurality of 2-2 connection pipes are disposed to intersect each other.

The second front side row and the second rear side row are disposed in a space between the first front side row and the first rear side row.

The heat pipe unit according to the present disclosure may further include: a first header provided inside the casing part, connected to the plurality of heat pipes disposed in a most in the front side row, and storing fluid moving to the plurality of heat pipes; and a second header provided inside the casing part, connected to the plurality of heat pipes disposed in a most rear side row, and storing fluid heat-exchanged with the exhaust gas.

The heat pipe unit according to the present disclosure may further include a plurality of support sheets provided to be spaced apart from each other in a longitudinal direction of the heat pipes inside the casing part to support the plurality of the heat pipes, wherein each of the support sheets may have the plurality of heat pipes passing therethrough and be provided with a plurality of through holes to support a circumferential surface of each of the plurality of heat pipes passing therethrough.

In addition, the boiler may include:

a casing part providing a flow path through which exhaust gas flows; and a heat pipe unit, wherein the heat pipe unit comprises a plurality of heat pipes provided inside a casing part of a waste heat recovery boiler a plurality of connection pipes connecting the plurality of heat pipes to each other, wherein the plurality of heat pipes has a fluid which moves thereinside and exchanges heat with exhaust gas flowing out to an outside the casing part, the plurality of heat pipes being disposed in a plurality of rows along a direction in which the exhaust gas flows, wherein the plurality of connection pipes may include: a plurality of first connection pipes disposed in oblique directions and connecting the plurality of heat pipes disposed in a first front side row with the plurality of heat pipes disposed in a first rear side row; and a plurality of second connection pipes connecting the plurality of heat pipes disposed in a second front side row with the plurality of heat pipes disposed in a second rear side row, and disposed not to be parallel with the plurality of first connection pipes, wherein the first front and rear side rows and the second front and rear side rows are referred to on the basis of the direction in which the exhaust gas flows.

As described above, according to a heat pipe unit and a waste heat recovery boiler including the same, the plurality of heat pipes having a fluid, which exchanges heat with exhaust gas flowing out to an outside thereof, moving thereinside is disposed in a plurality of rows along a direction in which the exhaust gas flows to be perpendicular to the flow direction of the exhaust gas, and the plurality of heat pipes of the corresponding front side row and the plurality of heat pipes of the corresponding rear side row, which are spaced apart from each other, are connected through the plurality of connection pipes in a shape of a zigzag or a shape being intersected, whereby the fluid can be moved uniformly through the heat pipes and thus made to have heat absorption from the exhaust gas uniformly accomplished. Accordingly, the performance of the waste heat recovery boiler can be prevented from degrading.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Hereinafter, exemplary embodiments according to the present disclosure will be described in detail with reference to the accompanying drawings. Prior to this, it is noted that terms or words used in the present specification and claims should not be construed as being limited to the usual or dictionary meaning because, on the basis of the principle that the inventor may define the concept of the terms in order to explain his/her invention in the best way, the terms and words should be interpreted as meaning and concept consistent with the technical idea of the present disclosure.

Figure 1:
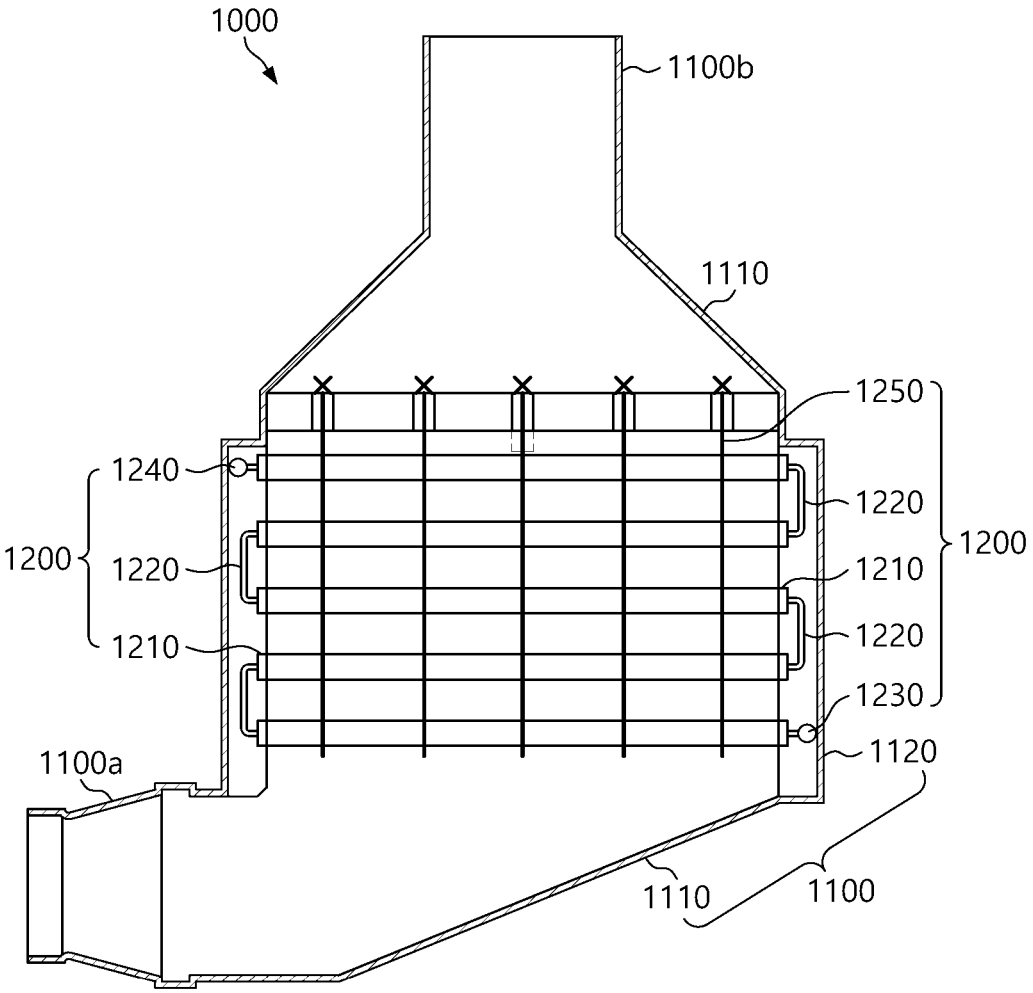
FIG. 1 is a view schematically showing a waste heat recovery boiler according to an embodiment of the present disclosure.

With reference to FIG. 1, a waste heat recovery boiler 1000 according to an embodiment of the present disclosure includes a casing part 1100 and a heat pipe unit 1200. The casing part 1100 has a substantially cubic shape and provides a flow path through which exhaust gas flows. The exhaust gas flows from the bottom of the casing part 1100 toward the top of the casing part 1100.

Figure 2:
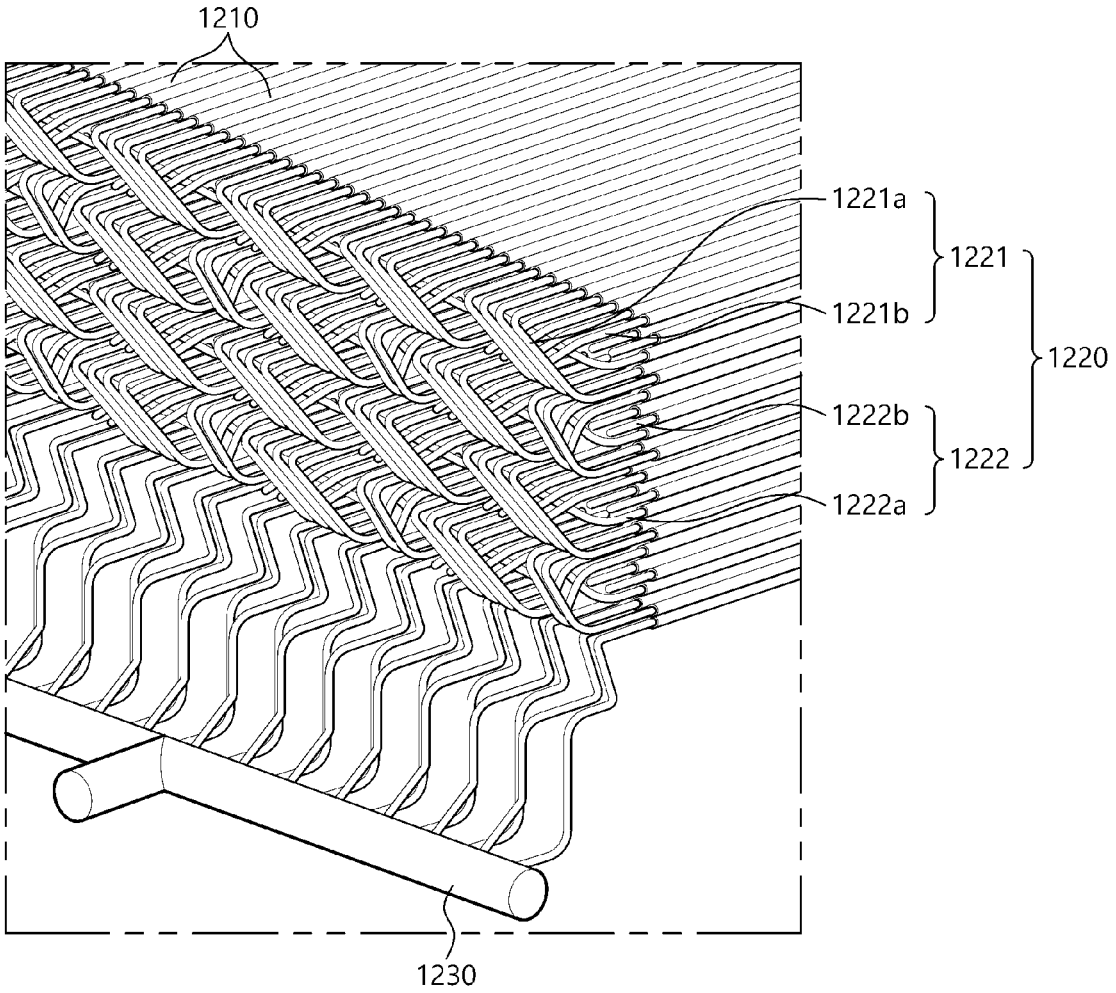
FIG. 2 is a view schematically showing a state in which a plurality of heat pipes are connected by connection pipes and disposed in a plurality of rows inside a casing part shown in FIG. 1.

With reference to FIGS. 1 and 2, the casing part 1100 is provided inside thereof with the heat pipe unit 1200. The heat pipe unit 1200 includes a plurality of heat pipes 1210, a plurality of connection pipes 1220. The plurality of heat pipes 1210 are disposed in a plurality of rows and are perpendicular to the flow direction of exhaust gas. The plurality of connection pipes 1220 connect the plurality of heat pipes 1210. The plurality of heat pipes 1210 disposed in the plurality of rows are classified into superheaters, evaporators, and the like according to their roles.

The casing part 1100 includes casings 1110 and a thermal expansion absorbing member 1120. According to an embodiment, the casing part 1100 may include at least two casings 1110 separated from each other, and the at least two casings 1110 separated from each other may be connected by the mediation of the thermal expansion absorbing member 1120 which is capable of absorbing potential deformation caused by thermal expansion.

One side of the casing 1100 may be provided with a gas inlet 1100*a* through which the exhaust gas from a gas turbine (not shown) is introduced, and an opposite side may be provided with a gas outlet 1100*b* for discharging the exhaust gas into the atmosphere.

The casing 1110 may be provided in a metallic material, thereby being able to be thermally expanded by high-temperature exhaust gas. The thermal expansion absorbing member 1120 may be configured to have fluidity in order to mitigate the thermal expansion of the casings 1110 separated from each other.

Figure 3:
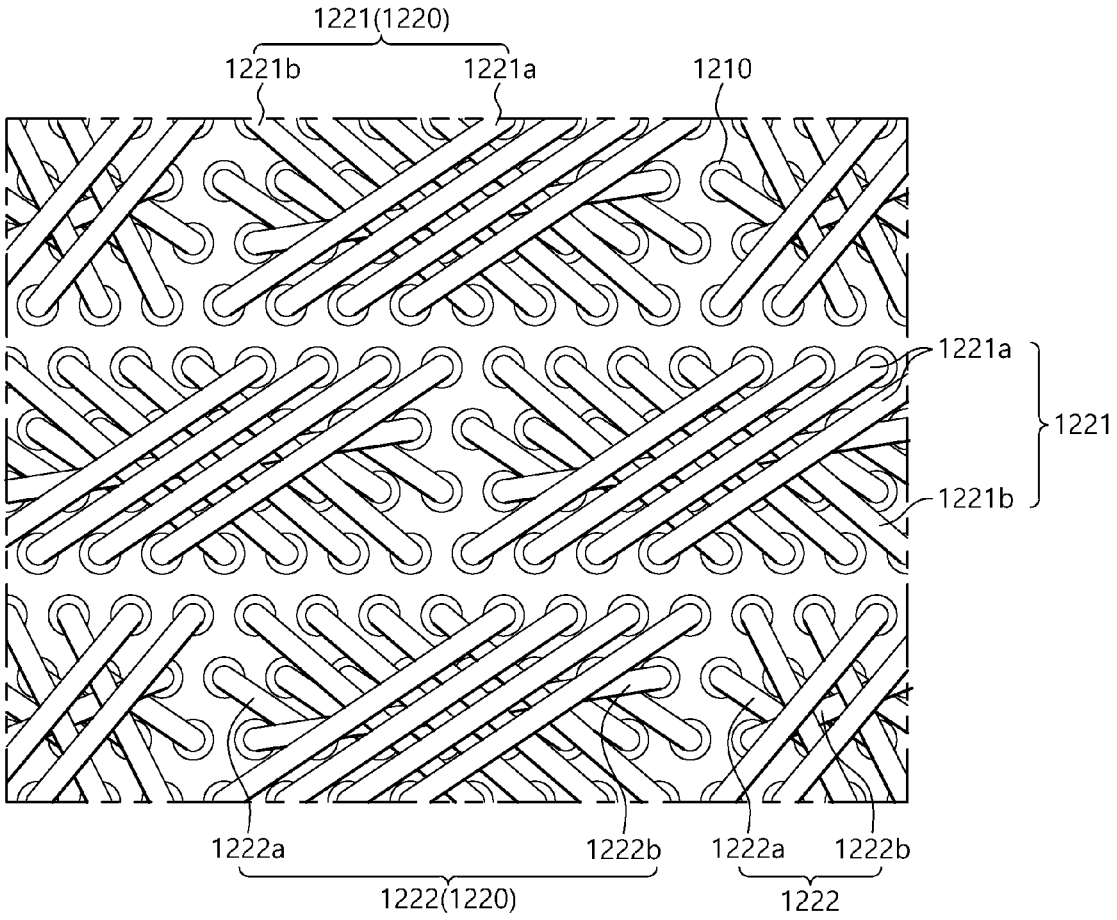
FIG. 3 is an enlarged view of a state in which the plurality of heat pipes shown in FIG. 2 is connected by a plurality of first connection pipes and a plurality of second connection pipes.
Figure 4:
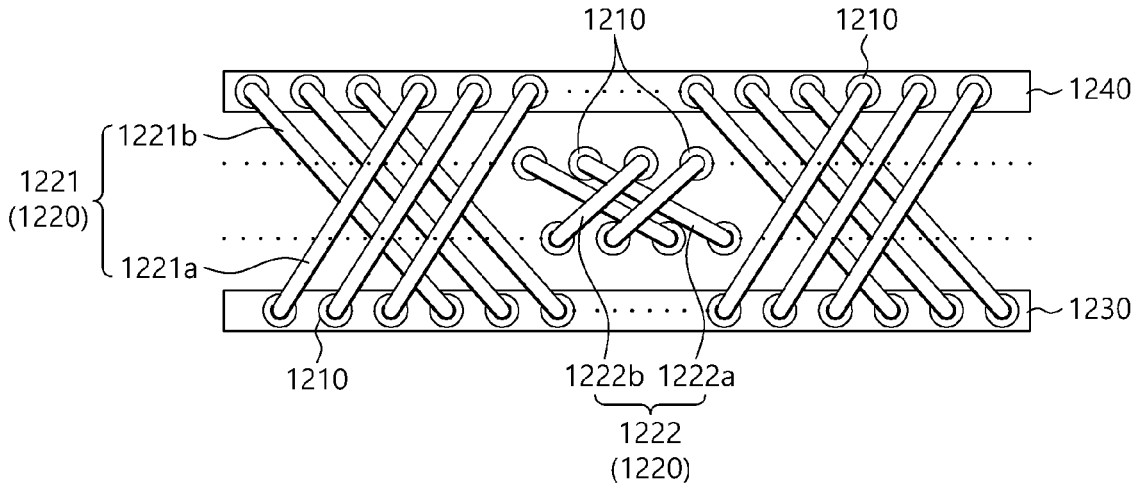
FIG. 4 is a view schematically showing a state in which the plurality of heat pipes shown in FIG. 2 is connected to a first header and a second header.

With reference to FIGS. 2 to 4, the plurality of connection pipes 1220 connects the plurality of heat pipes 1210 disposed in the plurality of rows along the direction in which the exhaust gas flows inside the casing 1100. The plurality of connection pipes 1220 includes a plurality of first connection pipes 1221 and a plurality of second connection pipes 1222. The diameter of each of the connection pipes 1220 may be smaller than the diameter of each of the heat pipes 1210. The opposite ends of each of the connection pipes 1220 are respectively inserted into one end of each of the two corresponding heat pipes 1210. This arrangement ensures that the two heat pipes 1210 and the one connection pipe 1220 are connected in a corresponding manner.

Throughout the specification, an upstream side and a downstream side in the casing part 1100 are defined based on the direction in which the exhaust gas flows within the casing part 1100. The upstream side and the downstream side may be referred to as a front side and a rear side, respectively.

The plurality of the first connection pipes 1221 connects the plurality of heat pipes 1210 disposed in the corresponding front side row with the plurality of heat pipes 1210 disposed in the corresponding rear side row. These heat pipes 1210 in the rear side row are disposed spaced apart from the ones disposed in the corresponding front side row in the flow direction of the exhaust gas. The plurality of the first connection pipes 1221 are disposed in oblique directions. The heat pipes 1210 in the front side row and the heat pipes 1210 in the rear side row connected by the plurality of the first connection pipes 1221 may be spaced apart such that other multiple heat pipes 1210 are disposed therebetween that are not connected by the first connection pipes 1221. The front side row and the rear side row that are connected to each other by the first connection pipes 1221 may be referred to as the first front side row and the first rear side row.

The plurality of first connection pipes 1221 connects the plurality of heat pipes 1210 disposed in the front row and the plurality of heat pipes 1210 disposed in the rear row in an oblique direction relative to the flow direction of the exhaust gas, rather than in a parallel direction there to. This arrangement ensure that even if the temperature of the exhaust gas varies at different flow positions with the casing part 1100, heat exchange remain uniform. The fluid moving inside the plurality of the heat pipes 1210 connected by the plurality of first connection pipes 1221 achieves consistent heat absorption and transfer throughout the system.

The plurality of the second connection pipes 1222 connects the plurality of heat pipes 1210 disposed in the corresponding front side row with the plurality of heat pipes 1210 disposed in the corresponding rear side row. The plurality of the second connection pipes 1222 are disposed in an oblique direction relative to the flow direction of the exhaust gas, but not parallel to the plurality of the first connection pipes 1221. In this case, the plurality of the first connection pipes 1221 and the plurality of the second connection pipes 1222 may be intersected with each other when viewed in a direction parallel to a longitudinal direction along the heat pipes 1210 in an elongated shape. The front side row and the rear side row that are connected to each other by the second connection pipes 1222 may be referred to as the second front side row and the second rear side row.

The plurality of heat pipes 1210 connected by the plurality of the second connection pipes 1222 may be disposed between the plurality of heat pipes 1210 connected by the plurality of the first connection pipes 1221. Specifically, when the front side row and the rear side row, in which the heat pipes 1210 connected by the first connection pipes 1221 are positioned, are spaced part from each other, the heat pipes 1210 connected by the second connection pipes 1222 may be placed between the front side row and the rear side row, i.e., between the first front side row and the first rear side row.

According to the present disclosure, the plurality of heat pipes 1210 disposed in the plurality of rows along the direction in which the exhaust gas flows within the casing 1100 is connected by the plurality of first connection pipes 1221 and the plurality of second connection pipes 1222 disposed in oblique directions relative the flow direction of the exhaust gas. This arrangement ensure that even if the temperature of the exhaust gas varies at different flow positions with the casing part 1100, heat exchange remain uniform. The fluid moving inside the plurality of the heat pipes 1210 connected by the plurality of first connection pipes 1221 and the plurality of the second connection pipes 1222 achieves consistent heat absorption and transfer throughout the system.

According to an embodiment, the plurality of first connection pipes 1221 may include a plurality of 1-1 connection pipes 1221*a* and a plurality of 1-2 connection pipes 1221*b*. The plurality of 1-1 connection pipes 1221*a* may be disposed in a first oblique direction and the plurality of 1-2 connection pipes 1221*b* may be disposed in a second oblique direction different from the first oblique direction. The first oblique direction may be inclined relative to the flow direction of the exhaust gas and the second oblique direction may be inclined in an opposite direction to the first oblique direction relative to the flow direction of the exhaust gas.

The plurality of 1-1 connection pipes 1221*a* connects a portion of the plurality of heat pipes 1210 disposed in the corresponding front side row and a portion of the plurality of heat pipes 1210 disposed in the corresponding rear side row, when the front side row and the rear side row are spaced apart in the flow direction of the exhaust gas.

The plurality of 1-2 connection pipes 1221*b* connects another portion of the plurality of heat pipes 1210 disposed adjacent to the plurality of heat pipes connected by the plurality of 1-1 connection pipes 1221*a*, wherein the plurality of heat pipes 1210 connected by the plurality of 1-2 connection pipes 1221*b* are in the same front and rear side rows with the plurality of heat pipes 1210 connected by the plurality of 1-1 connection pipes 1221*a*, respectively.

The plurality of 1-1 connection pipes 1221*a* and the plurality of 1-2 connection pipes 1221*b* may be disposed in an oblique direction. The plurality of 1-1 connection pipes 1221*a* and the plurality of 1-2 connection pipes 1221*b* may be disposed not to be parallel to each other. The plurality of 1-1 connection pipes 1221*a* and the plurality of 1-2 connection pipes 1221*b* may be disposed to intersect each other when viewed in a direction parallel to a longitudinal direction along the heat pipes 1210 in an elongated shape. The inclined direction of the oblique direction in which the plurality of 1-1 connection pipes 1221*a* is disposed may be an opposite direction to the inclined direction of the oblique direction in which the plurality of 1-2 connection pipes 1221*b* is disposed, based on the flow direction of the exhaust gas. In other words, the plurality of heat pipes 1210 of the plurality of corresponding front and rear rows may be connected using the plurality of 1-1 connection pipes 1221*a* and the plurality of 1-2 connection pipes 1221*b* in optimal directions in which the heat exchange may be uniformly performed between the fluid moving inside the plurality of heat pipes 1210 and the exhaust gas flowing outside the plurality of heat pipes 1210.

The plurality of second connection pipes 1222 connecting the plurality of heat pipes 1210 disposed in the corresponding front side row and the corresponding rear side row in a direction not to be parallel to or of being intersected with the plurality of first connection pipes 1221 includes a plurality of 2-1 connection pipes 1222*a* and a plurality of 2-2 connection pipes 1222*b*.

The plurality of 2-1 connection pipes 1222*a* connects a portion of the plurality of heat pipes 1210 disposed in the corresponding front side row and a portion of the plurality of heat pipes 1210 disposed in the corresponding rear side row, so as to be intersected with the plurality of first connection pipes 1221. Here, the plurality of 2-1 connection pipes 1222*a* may be connected to the plurality of heat pipes 1210 in a direction of being intersected with or a direction of not to be parallel to the plurality of 1-1 connection pipes 1221*a* of first connection pipes 1221.

The plurality of 2-2 connection pipes 1222*b* connects another portion of the plurality of heat pipes 1210 disposed adjacent to the plurality of heat pipes connected by the plurality of 2-1 connection pipes 1222*a*, wherein the plurality of heat pipes 1210 connected by the plurality of 2-2 connection pipes 1222*b* are in the same front and rear side rows with the plurality of heat pipes 1210 connected by the 2-1 connection pipes 1222*a*, respectively. Here, the plurality of 2-2 connection pipes 1222*b* may be disposed in a direction of being intersected with or a direction of not to be parallel to the plurality of 1-2 connection pipes 1221*b* of first connection pipes 1221.

The plurality of 2-1 connection pipes 1222*a* and the plurality of 2-2 connection pipes 1221*b* may be disposed in an oblique direction. The plurality 2-1 connection pipes 1222*a* and the plurality of 2-2 connection pipes 1222*b* may be disposed not to be parallel to each other. The plurality 2-1 connection pipes 1222*a* and the plurality of 2-2 connection pipes 1222*b* may be disposed to intersect each other when viewed in a direction parallel to a longitudinal direction along the heat pipes 1210 in an elongated shape. The inclined direction of the oblique direction in which the plurality of 2-1 connection pipes 1222*a* is disposed may be an opposite direction to the inclined direction of the oblique direction in which the plurality of 2-2 connection pipes 1222*b* is disposed, based on the flow direction of the exhaust gas. In other words, the plurality of heat pipes 1210 of the plurality of corresponding front and rear rows may be connected using the plurality of 2-1 connection pipes 1222*a* and the plurality of 2-2 connection pipes 1222*b* in optimal directions in which the heat exchange may be uniformly performed between the fluid and the exhaust gas.

With reference to FIGS. 1 to 4, the heat pipe unit 1200 may further include a first header 1230, a second header 1240, and a support sheet 1250. The first header 1230 is provided inside the casing 1110 of the casing part 1100, connected to the plurality of heat pipes 1210, which is provided to be spaced apart from each other in the front side row, and stores the fluid moving to the plurality of heat pipes 1210.

The second header 1240 is provided inside the casing part 1100 of the casing part 1100, connected to the plurality of heat pipes 1210, which is provided to be spaced apart from each other in the rear side row, and stores the fluid, which is heat-exchanged with the exhaust gas while moving through the plurality of heat pipes 1210 and the plurality of connection pipes 1220 after being supplied from the first header 1230.

The row, in which a plurality of heat pipes 1210 connected to the first header 1230 reside, may be referred to as the most front side row. The row, in which a plurality of heat pipes 1210 connected to the second header 1240 reside, may be referred to as the most rear side row.

A plurality of support sheets 1250 is provided inside the casing part 1100, wherein the plurality of support sheets 1250 is spaced apart from each other in the longitudinal direction of the plurality of heat pipes 1210 provided in the casing 1100 to serve the role of supporting the plurality of heat pipes 1210. Each of the support sheets 1250 has the plurality of heat pipes 1210 passing therethrough and may be provided with a plurality of through holes (not shown) to support a circumferential surface of each of the plurality of heat pipes 1210 passing therethrough.

According to the present disclosure, the plurality of heat pipes 1210 is disposed in a plurality of rows along a direction in which the exhaust gas flows to be perpendicular to the flow direction of the exhaust gas. The plurality of heat pipes 1210 of the corresponding front side row and the plurality of heat pipes 1210 of the corresponding rear side row, which are spaced apart from each other, are connected through the plurality of first connection pipes 1221 and the plurality of second connection pipes 1222 of the plurality of connection pipes 1220. The plurality of first connection pipes 1221 and the plurality of second connection pipes 1222 are disposed in a shape of a zigzag or a shape being intersected. This arrangement enables the fluid to be moved uniformly through the plurality of heat pipes 1210 and thus have uniform heat absorption from the exhaust gas. Accordingly, the performance of the waste heat recovery boiler may be prevented from degrading.

Although the present disclosure has been described with reference to the embodiments shown in the drawings, this is only exemplary, and those skilled in the art will understand that various modifications and equivalent other embodiments are possible therefrom. Therefore, the true technical protection scope of the present disclosure should be determined by the spirit of the technical writings of the appended claims. Also, it is noted that any one feature of an embodiment of the present disclosure described in the specification may be applied to another embodiment of the present disclosure.

The invention claimed is:

1. A heat pipe unit comprising:

a plurality of heat pipes provided inside a casing part of a waste heat recovery boiler; and a plurality of connection pipes connecting the plurality of heat pipes to each other, wherein the plurality heat pipes has a fluid which moves thereinside and exchanges heat with exhaust gas flowing out to an outside the casing part, the plurality of heat pipes being disposed in a plurality of rows along a direction in which the exhaust gas flows, wherein the plurality of connection pipes comprises:

a plurality of first connection pipes disposed in oblique directions and connecting the plurality of heat pipes disposed in a first front side row with the plurality of heat pipes disposed in a first rear side row; and a plurality of second connection pipes connecting the plurality of heat pipes disposed in a second front side row with the plurality of heat pipes disposed in a second rear side row, and disposed not to be parallel with the plurality of first connection pipes, wherein the first front and rear side rows and the second front and rear side rows are referred to on the basis of the direction in which the exhaust gas flows, wherein the plurality of first connection pipes comprises:

a plurality of 1-1 connection pipes connecting a first portion of the plurality of heat pipes in the first front side row and a first portion of the plurality of heat pipes in the first rear side row, which are spaced apart; and a plurality of 1-2 connection pipes connecting a second portion of the plurality of heat pipes in the first front side row and a second portion of the plurality of heat pipes in the first rear side row, wherein the second portion of the plurality of heat pipes in the first front side row is disposed adjacent to the first portion of the plurality of heat pipes in the first front side row, and the second portion of the plurality of heat pipes in the first rear side row is disposed adjacent to the first portion of the plurality of heat pipes in the first rear side row, wherein the plurality of 1-1 connection pipes and the plurality of 1-2 connection pipes are disposed to intersect each other, wherein the plurality of second connection pipes comprises:

a plurality of 2-1 connection pipes connecting a first portion of the plurality of heat pipes disposed in the second front side row and a first portion of the plurality of heat pipes disposed in the second rear side row, the plurality of 2-1 connection pipes intersecting with the plurality of 1-1 connection pipes; and a plurality of 2-2 connection pipes connecting a second portion of the plurality of heat pipes in the second front side row and a second portion of the plurality of heat pipes in the second rear side row, wherein the second portion of the plurality of heat pipes in the second front side row is disposed adjacent to the first portion of the plurality of heat pipes in the second front side row, and the second portion of the plurality of heat pipes in the second rear side row is disposed adjacent to the first portion of the plurality of heat pipes in the second rear side row, wherein the plurality of 2-1 connection pipes and the plurality of 2-2 connection pipes are disposed to intersect each other, wherein at least one of the 2-1 connection pipes and the plurality of 1-1 connecting pipes are disposed to intersect with each other, and at least one of the 2-2 connection pipes and the plurality of 1-2 connecting pipes are disposed to intersect with each other, wherein the second front side row and the second rear side row are disposed in a space between the first front side row and the first rear side row.

2. A waste heat recovery boiler, the boiler comprising:

a casing part providing a flow path through which exhaust gas flows; and a heat pipe unit, wherein the heat pipe unit comprises:

a plurality of heat pipes provided inside a casing part of a waste heat recovery boiler, and a plurality of connection pipes connecting the plurality of heat pipes to each other, wherein the plurality of heat pipes has a fluid which moves thereinside and exchanges heat with exhaust gas flowing out to an outside the casing part, the plurality of heat pipes being disposed in a plurality of rows along a direction in which the exhaust gas flows, wherein the plurality of connection pipes comprises:

a plurality of first connection pipes disposed in oblique directions and connecting the plurality of heat pipes disposed in a first front side row with the plurality of heat pipes disposed in a first rear side row; and a plurality of second connection pipes connecting the plurality of heat pipes disposed in a second front side row with the plurality of heat pipes disposed in a second rear side row, and disposed not to be parallel with the plurality of first connection pipes, wherein the first front and rear side rows and the second front and rear side are referred to on the basis of the direction in which the exhaust gas flows, wherein the plurality of first connection pipes comprises:

a plurality of 1-1 connection pipes connecting a first portion of the plurality of heat pipes in the first front side row and a first portion of the plurality of heat pipes in the first rear side row, which are spaced apart; and a plurality of 1-2 connection pipes connecting a second portion of the plurality of heat pipes in the first front side row and a second portion of the plurality of heat pipes in the first rear side row, wherein the second portion of the plurality of heat pipes in the first front side row is disposed adjacent to the first portion of the plurality of heat pipes in the first front side row, and the second portion of the plurality of heat pipes in the first rear side row is disposed adjacent to the first portion of the plurality of heat pipes in the first rear side row, wherein the plurality of 1-1 connection pipes and the plurality of 1-2 connection pipes are disposed to intersect each other, wherein the plurality of second connection pipes comprises:

a plurality of 2-1 connection pipes connecting a first portion of the plurality of heat pipes disposed in the second front side row and a first portion of the plurality of heat pipes disposed in the second rear side row, the plurality of 2-1 connection pipes intersecting with the plurality of 1-1 connection pipes; and a plurality of 2-2 connection pipes connecting a second portion of the plurality of heat pipes in the second front side row and a second portion of the plurality of heat pipes in the second rear side row, wherein the second portion of the plurality of heat pipes in the second front side row is disposed adjacent to the first portion of the plurality of heat pipes in the second front side row, and the second portion of the plurality of heat pipes in the second rear side row is disposed adjacent to the first portion of the plurality of heat pipes in the second rear side row, wherein the plurality of 2-1 connection pipes and the plurality of 2-2 connection pipes are disposed to intersect each other, wherein at least one of the 2-1 connection pipes and the plurality of 1-1 connecting pipes are disposed to intersect with each other, and at least one of the 2-2 connection pipes and the plurality of 1-2 connecting pipes are disposed to intersect with each other, wherein the second front side row and the second rear side row are disposed in a space between the first front side row and the first rear side row.

* * * * *